United States Patent [19]

Goldstein

[11] 4,201,262

[45] May 6, 1980

[54] COOLER FOR CHILLING A WORKING FLUID

[76] Inventor: Stanley A. Goldstein, 4458 Estrondo Dr., Encino, Calif. 91631

[21] Appl. No.: 931,599

[22] Filed: Aug. 7, 1978

[51] Int. Cl.[2] ..... F28D 3/04

[52] U.S. Cl. ..... 165/117; 62/394; 62/399; 239/193

[58] Field of Search ..... 165/117, 115; 62/310, 62/394, 396, 399; 239/193, 558

[56] References Cited

U.S. PATENT DOCUMENTS

| | | | |
|---|---|---|---|
| 1,987,097 | 1/1935 | Coubrough | 239/193 |
| 2,119,864 | 6/1938 | Kleucker | 62/394 |
| 2,348,601 | 5/1944 | Buschow et al. | 165/117 |
| 2,509,031 | 5/1950 | Bockmeyer | 62/310 |
| 2,752,124 | 6/1956 | Nofziger | 62/310 |
| 2,932,490 | 4/1960 | Olander | 165/117 |
| 3,412,778 | 11/1968 | Witt et al. | 165/115 |
| 3,461,684 | 8/1969 | Simpson | 165/117 |
| 4,071,078 | 1/1978 | Padden | 62/399 |

FOREIGN PATENT DOCUMENTS

| | | | |
|---|---|---|---|
| 74480 | 5/1929 | Sweden | 239/193 |
| 142454 | 4/1921 | United Kingdom | 165/117 |
| 821876 | 10/1959 | United Kingdom | 62/310 |

*Primary Examiner*—Sheldon Richter
*Attorney, Agent, or Firm*—Jessup & Beecher

[57] ABSTRACT

A cooler for chilling a working fluid used in a manufacturing or production process comprised of a tank having a reservoir in the bottom and one or more cooling coils mounted above the reservoir. A metering plate is inserted in the tank above the cooling coils to distribute the working fluid to be cooled over the refrigerant-containing coil at a predetermined rate. The metering plate has a plurality of tapered metering holes in a circular pattern aligned with each coil of the cooling coils mounted in the tank. The metering holes evenly distribute the hot working fluid over the cooling coils. Distribution and overflow barriers are provided on the metering plate to provide a constant maximum flow of hot working fluid through the cooling tank. Refrigerant is pumped through the cooling coils from the bottom to the top in a counterflow action with respect to the hot working fluid to be cooled. With proper selection of the metering holes, distribution and overflow barriers on the metering plate the cooler can be constructed to automatically maintain a predetermined amount of cooling.

14 Claims, 7 Drawing Figures

COOLER FOR CHILLING A WORKING FLUID

BACKGROUND OF THE INVENTION

This invention relates to cooling devices or chillers and more particularly relates to a working fluid cooling device.

There are many devices now on the market to provide cooling or chilling of a working fluid used in manufacturing processes such as plastic injecting molding. These devices come in various forms, for example, one such device is comprised of a cylindrical manifold having a plurality of tubes having fins through which a refrigerant is circulated. The working fluid, such as water, is circulated in a counterflow direction through the manifold around the outside of the chiller or cooling tubes. In this device the cooling tubes are completely submerged and the device is a high-energy user because of the restrictions created by the tubes, fins in the tubes, and the manifold or cylinder.

Other devices similar to that described have been constructed but they also suffer from the disadvantage of being complex in construction and are also high-energy users. These constructions are expensive to produce because of their complexity and are low in efficiency for a variety of reasons, among which is the use of submerged coils. Other disadvantages are the poor return of lubricating oil at low temperatures and freeze-up problems.

SUMMARY OF THE INVENTION

The purpose of the present invention is to provide a cooling apparatus which can circulate high volumes to provide high-efficiency cooling with minimum energy consumption.

The present invention is a cooler having a tank with a reservoir at the bottom and one or more vertically oriented coils for circulation of a working fluid to be cooled. The working fluid is delivered to a metering plate at the top of the tank above the cooling coils and is allowed to flow over the cooling coils by the force of gravity. Metering holes in the metering plate automatically control the rate of flow and amount of cooling accomplished by the working fluid dripping down over the cooling coils. A distribution barrier on the metering plate produces an even distribution of working fluid over the metering plate to be cooled by the coils. An overflow barrier is provided in the center of the metering plate with a large overflow duct for maintaining the flow and the amount of cooling at a maximum.

The metering holes are arranged in the metering plate in a circular pattern aligned with each coil around the cooling tubes allowing the working fluid to drip evenly downward over the cooling coils. The metering holes are tapered to assure a smooth flow to provide maximum contact between the working fluid and the cooling coils. Refrigerant is circulated through the cooling tubes from the bottom to the top to provide counterflow cooling.

In operation a working fluid used in a manufacturing process or for comfort cooling is pumped into the tank and poured onto the metering plate through a distribution nozzle. The working fluid is dumped on the metering plate between a distribution barrier and the overflow barrier which causes the working fluid to be dispersed around the metering plate at an even level. The overflow barrier permits excess working fluid to flow through a central aperture or duct in the metering plate directly into the reservoir without contacting the cooling coils. Therefore, the amount of cooling is determined by the maximum flow permitted by the metering holes in the metering plate. The use of gravity flow and overflow tube or duct eliminates any flow resistance and allows maximum cooling conditions to be maintained.

The reservoir at the bottom of the tank is provided with fill and overflow ducts or tubes to maintain the reservoir level for a constant flow of cool working fluid while keeping the cooling coils substantially above the cooled working fluid. Thus, the cooling coils are never submerged beneath the working fluid. The size and capacity of the coolers is determined by preselecting the number of coils in the cooling tubes and the number of holes in the metering plates to circulate a predetermined volume.

It is one object of the present invention to provide a cooler in which a working fluid to be cooled can flow without restriction.

Another object of the present invention is to provide a cooler in which the cooling coils are not submerged in the cooled working fluid.

Another object of the present invention is to provide a cooler which distributes a working fluid to be cooled evenly over one or more sets of cooling coils.

Another object of the present invention is to provide a cooler through which a high capacity of working fluid can be circulated without resistance.

Yet another object of the present invention is to provide a cooler which is relatively simple in construction.

Still another object of the present invention is to provide a cooler having a metering plate which automatically regulates the amount of working fluid to be cooled by controlling the volume of flow.

Other objects, advantages and novel features of the invention will become apparent from the following detailed description of the invention when considered in conjunction with the accompanying drawings wherein like parts are identified by like numbers throughout.

DETAILED DESCRIPTION OF THE PREFERRED EMBODIMENT

Figure 1:
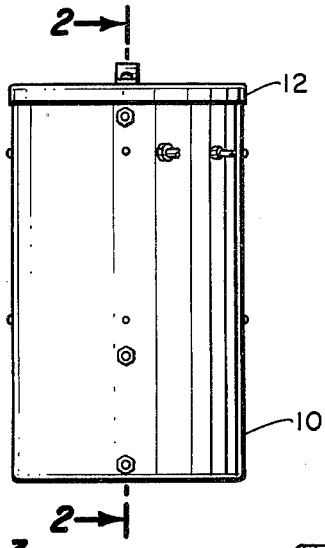
FIG. 1 is a side elevation of a cooler according to the invention.
Figure 2:
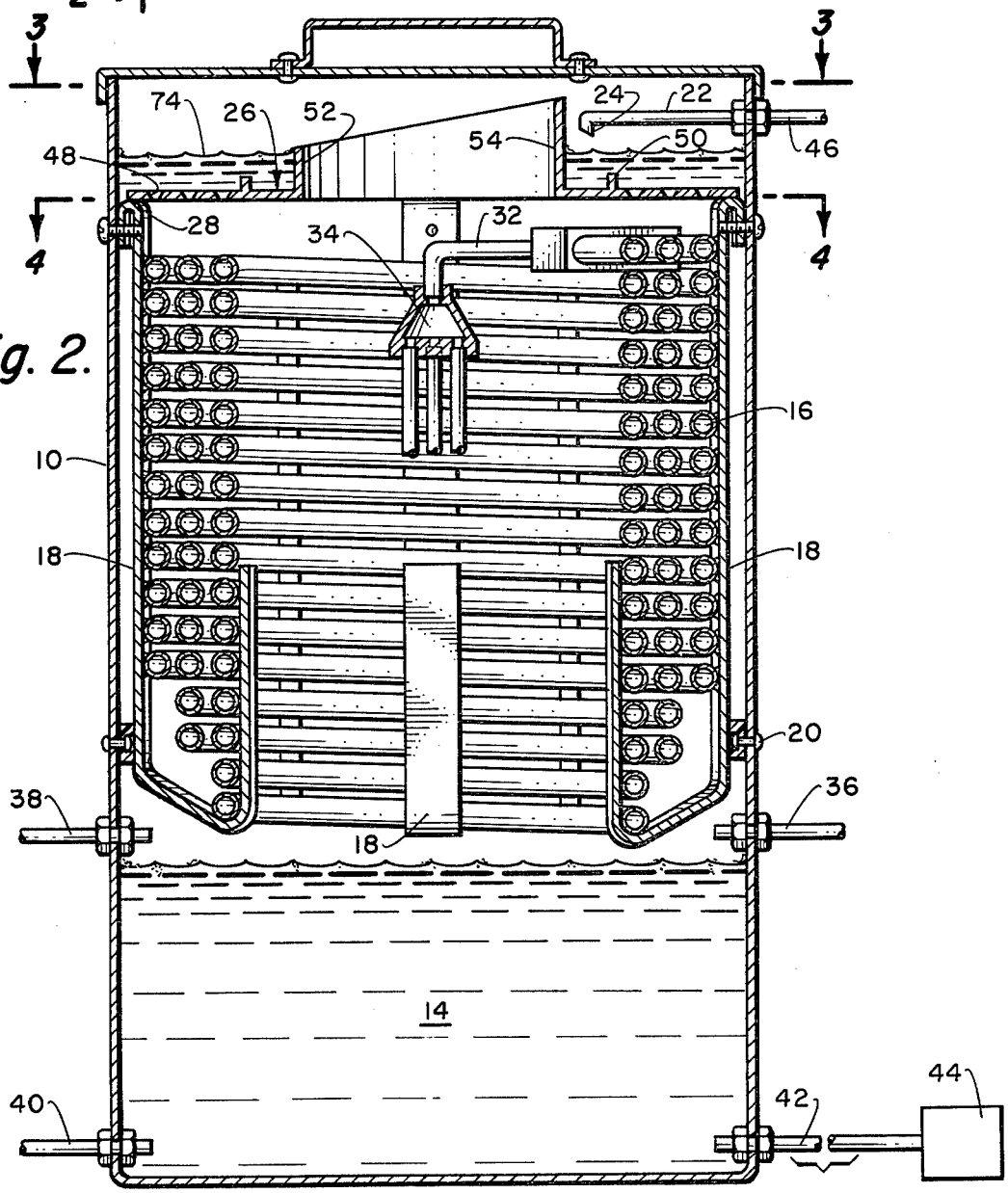
FIG. 2 is a sectional side elevation of the cooling device taken at 2—2 of FIG. 1.

Referring now to FIG. 1, there is shown a cooling tank 10 having a removable cover 12 for cooling a variety of working fluids used in various manufacturing processes or for comfort cooling (i.e. air conditioning systems). The details of the cooling function of the cooling tank are illustrated in FIG. 2.

The cooling tank 10 has a reservoir 14 at the bottom of the tank above which is mounted a cooling coil assembly 16 supported by brackets 18 secured by screws 20 in the tank. Fluid to be cooled is delivered to the cooling tank by means of a pipe 22 terminating in a nozzle or spout 24 above a metering plate 26. The metering plate 26 rests on the upper end 28 of the brackets 18 supporting the coils. Thus, the metering plate may easily be lifted out of the tank for cleaning or repair, if necessary.

Refrigerant is delivered to the cooling coils through inlet 30 and pipe 32 to distributor or manifold 34 connected to distribute the refrigerant easily between the coils of the coil assembly 16. The cooling tank reservoir 14 is filled through inlet 36 to a level controlled by overflow outlet 38 just below the cooling coil assembly 16. A drain 40 is provided to empty the reservoir 14 for cleaning and repair, if desired.

Cooled working fluid is drawn from the tank through outlet 42 and returned to a load to be cooled by a pump 44. The load can be any type of manufacturing process or comfort cooling, such as in manufacturing of plastic parts. After use in the manufacturing process, the working fluid is returned to the cooler inlet 46 for delivery by pipe 22 to the metering plate 26. Of course, the cooling tank 10 would be provided with a suitable insulator such as a foam covering (not shown).

Figure 3:
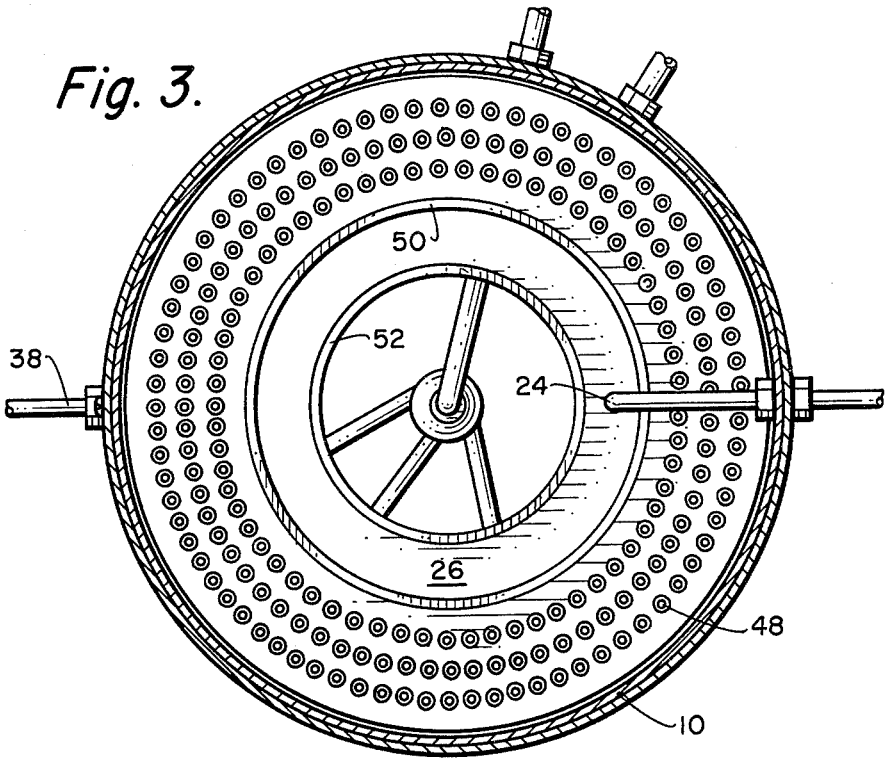
FIG. 3 is a sectional top view of the cooling device taken at 3—3 of FIG. 2.

The cooling system presents no restriction or resistance to the flow of working fluid and can handle as much fluid as can be pumped through the inlet 46 to the metering plate 26. The metering plate 26 is significant because it automatically controls the amount of cooling of the working fluid by controlling the amount of flow of cooling fluid over the coil assembly 16. A plurality of drip holes 48 arranged in circular patterns, as illustrated in FIG. 3, controls the amount and rate of flow cooled by the cooling coil assembly 16. The drip holes 48 in each circular pattern are aligned with a respective coil in the cooling coil assembly to assure that the working fluid to be cooled flows evenly over the cooling coils to maximize cooling efficiency. In order to produce a smooth even flow of working fluid over the cooling coil assembly, the drip holes 48 are tapered or countersunk.

The size and number of cooling drip holes 48 are selected according to the amount of cooling desired and the capacity of the cooling coil assembly 16. For example, for five-ton coolers (i.e. 60,000 btu) a suitable amount of circulation might be fifteen gallons per minute. The size and number of holes would then be selected to provide this amount of flow over the cooling coil assembly 16. It should be noted at this point that the amount of flow of working fluid to be cooled over the cooling coil assembly is automatically determined by the metering plate 26 regardless of the amount of flow from the spout 24. However, for maximum efficiency, the amount of working fluid delivered through the spout 24 should exceed the capacity of the drip holes 48 in the metering plate 26.

The metering plate 26, in addition to having the metering drip holes 48, has a distribution barrier 50 and an overflow barrier 52 having a splash guard 54. The distribution barrier 50, along with overflow barrier 52, creates an even distribution of working fluid over the entire metering plate 26 delivered from the spout 24. The overflow barrier 52 maintains the level of the working fluid on the metering plate at an even level to permit maximum flow through the metering drip holes 48. The ratio of the overflow barrier 52 to the distribution barrier 50 is approximately 3-to-1 to provide the maximum flow and even distribution. The splash guard or plate 54 is formed by an extension of the overflow tube or barrier 52 to prevent the working fluid exiting from the spout 24 from spilling over the overflow barrier at high volume flow. The splash guard or portion of the overflow barrier 52 is in the order of twice to three times the height of the lower side of the overflow barrier or duct 52.

Figure 6:
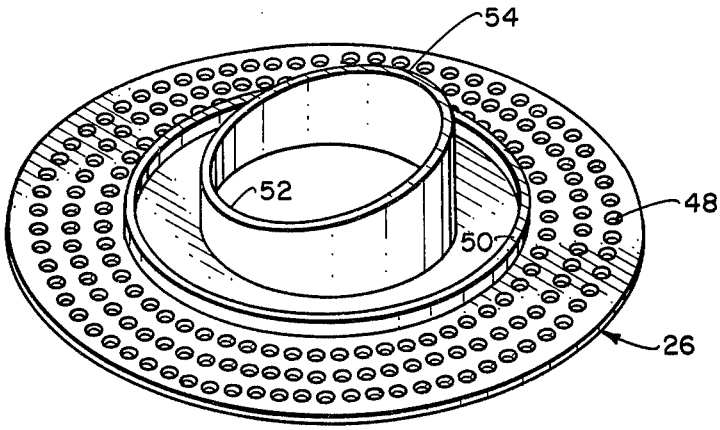
FIG. 6 is a perspective view illustrating the metering plate of the invention.

The details of the metering plate can be seen in FIGS. 3 and 6 illustrating the circular pattern of the drip holes 48 which are aligned respectively with each coil in the cooling coil assembly 16. By permitting unrestricted flow of working fluid through the cooling tank, the amount of cooling can be automatically regulated by the size and number of drip holes 48, while permitting the excess working fluid to spill over barrier 52 into the reservoir 14. Cooling efficiency is also maximized by maintaining the cooling coil assembly above rather than submerged in the working fluid to be cooled.

Figure 4:
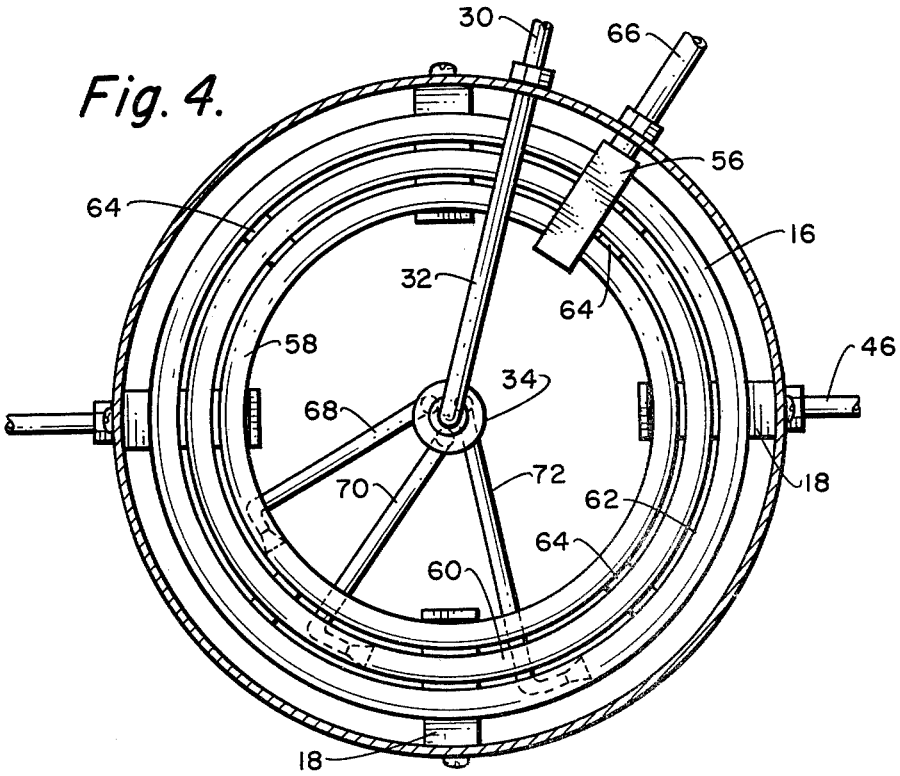
FIG. 4 is a sectional view of the cooling device taken at 4—4 of FIG. 2.

As can be seen, the cooling tank is relatively simple in construction, permitting easy removal of parts for repair or replacement. The cooling tank has a lid or cover 12 which can be removed easily as well as the metering plate 26 exposing the cooling coil assembly 16, as illustrated in FIG. 4. This cooling coil assembly 16 can be easily removed and replaced by simply unfastening or removing the screws 20, disconnecting the cooling inlet pipe 32 and the coolant output manifold 56 and lifting the cooling coil from the tank for repair or replacement.

Figure 7:
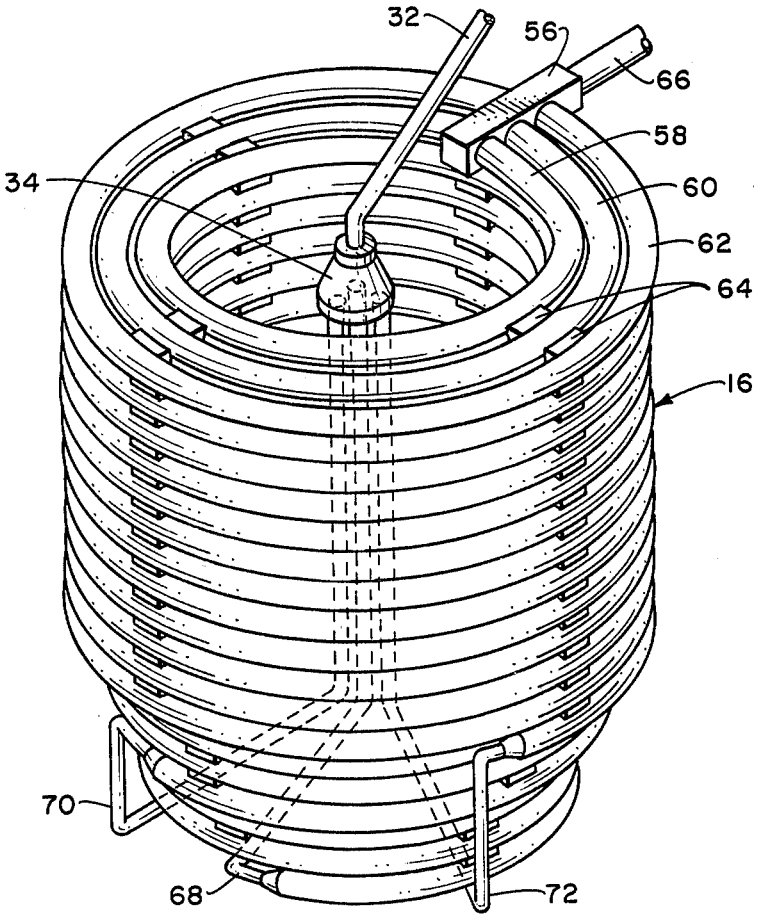
FIG. 7 is a perspective view illustrating the cooling coil construction of the device illustrated in FIG. 2.

The cooling coil assembly 16 is shown in greater detail in FIG. 7. The cooling coil assembly is constructed of three concentric coils connected to a distribution manifold or header 34 for equal and even distribution of refrigerant. The refrigerant is delivered to the bottom of each coil to produce a counterflow with the working fluid to be cooled. Since the cooling coils 58, 60, and 62 of the cooling coil assembly are arranged concentrically, each successive cooling coil from the outside to the inside is made successively longer in order to circulate the same amount of coolant and provide equal cooling of the working fluid throughout. Refrigerant enters the distribution manifold 34 through the pipe 32 and is delivered to the bottom end of the respective coils 58, 60 and 62 through respective pipes 68, 70 and 72.

As was stated previously, the cooling assembly 16 is comprised of three concentric equal capacity coils 58, 60 and 62, preferably copper, in a welded assembly, joined in fixed relationship to each other by spacers 64 between the coils and welded thereto. The spacers 64 maintain the relative spacing of each respective coil and yet provide a unitized cooling coil assembly 16. Refrigerant is circulated through the cooling coil assembly 16 through pipe 32, distribution manifold 34, to respective pipes 68, 70 and 72, to the respective coils 58, 60 and 62 and is circulated from bottom to top, finally exiting through collecting manifold 56 for delivery to outlet pipe 66.

In operation the cooling system receives water or some other working fluid through inlet pipe 46 from a load which may be from any manufacturing process employing a coolant. The coolant flows through pipe 22 out of spout 24 onto metering plate 26. For maximum efficiency the coolant should be delivered at a rate exceeding the amount for which the metering plate 26 is constructed. That is, if the metering drip holes 48 are constructed for a flow of fifteen gallons per minute, then the flow through the spout 24 should be greater than this amount.

There is a great advantage to this type of construction because the flow can greatly exceed the amount the metering plate can deliver through metering drip holes 48 and yet pump energy efficiency is not reduced because there is no restriction or back pressure against the flow. Thus, even with high-volume flow from spout 24, the water or working fluid will be evenly distributed over the metering plate until it reaches a level indicated at 74 (FIG. 1), approximately equal to the lowest side of the overflow barrier 52. The excess working fluid will then spill over down through the center of the cooling coil assembly 16 into the reservoir 14 unrestricted. The overflow outlet 38 will prevent the reservoir from ever rising above the level shown, maintaining the cooling coil assembly above the cooled working fluid. This, plus the fact that the coolant is accomplished by gravity flow of the working fluid over the cooling coil assembly, effectively prevents any freeze-ups of the system prevalent in prior art systems. For example, in systems with submerged cooling coils, freeze-ups frequently occur when the machine stops because the working fluid remains stationary allowing excessive cooling and causing freeze-up around the cooling coil assembly. However, with a chiller according to the present invention, the working fluid will continue to flow through the metering plate over the cooling coil assembly 16 even though the machine or pump 44 has ceased or stopped circulation of the working fluid. The resistance to flow of prior art devices has generally limited the cooling to only a few degrees below 40° F. However, with a device constructed according to the present invention, temperatures only a fraction of a degree above freezing have been attained without any freeze-up problems.

The fact that the system of the present invention does not require high energy for circulation of the working fluid because of the unrestricted flow and the use of gravity flow in cooling, the problem of poor oil return at low temperatures of prior art devices has been substantially solved. Many working fluids used in manufacturing processes include a mixture of which an oil or hydrocarbon is included. The loss of this oil in the working fluid mixture can be seriously detrimental to the manufacturing process in which the working fluid is used. Therefore, this present invention provides an effective solution to this problem. That is, the present invention does not have any structure such as fins, baffles, etc., which can impede flow and trap oil.

Figure 5:
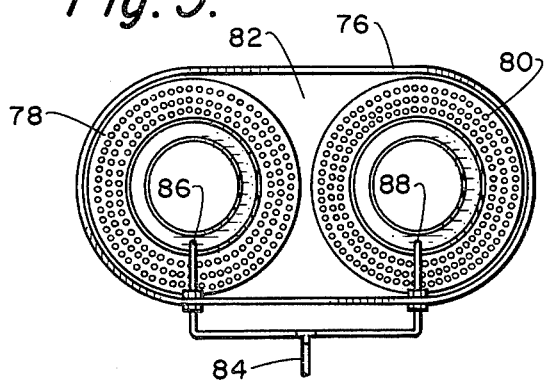
FIG. 5 is a semi-schematic illustration of an alternate embodiment of the invention.

The cooling system shown can be easily modified to effectively provide more or less cooling capacity. For example, the cooling coil assembly 16 illustrated in FIG. 2 can be reduced to a single coil for low capacities with a single circular pattern of drip holes 48. The multiple cooling coil assembly 16 shown can be used for large capacity devices. An additional increase in capacity can be provided by incorporating the principle of the device illustrated in FIG. 2 into an oval tank 76 as illustrated in FIG. 5. In the system illustrated in FIG. 5, two cooling coil assemblies (not shown) such as 16 of FIG. 2, would be installed side by side in the tank with a pair of circular metering plates placed above the coils. The metering plates 78 and 80 could be constructed as hole patterns employing distribution barriers and overflow barriers as illustrated on an oval-shaped plate conforming to the shape of the oval tak 76 or can be two metering plates 26 with a filler 82 in between, if desired. The former method simplifies the manufacture in that the coil assembly's metering plates and all parts, except the tank and connections, are changed. In the increased capacity tank 76 illustrated in FIG. 5, working fluid would be delivered through a conduit pipe 84 split and delivered through a pair of spouts 86 and 88 for flow distribution over a pair of cooling coil assemblies constructed in accordance with that shown in FIG. 7.

Thus, there has been disclosed a cooler which employs novel cooling techniques to eliminate the problems of freezing, oil return and high energy required to flow resistance systems. The system utilizes a novel metering plate to evenly distribute a working fluid through tapered metering drip holes over a cooling coil assembly through which a refrigerant is delivered in a counterflow system. Turn-off of the system does not provide any freeze-up problems because of the gravity flow and the fact that the working fluid will continue to drip through the metering drip holes 48 over the coils to continue to cool working fluid flowing in the system. This system is easy to disassemble for removal, repair or replacement of parts with a minimum of complex structures required. The metering plate can be simply lifted out of the device for repair or replacement as can the cooling coil assembly which can be removed as an assembly attached to the brackets 18 or can be removed separately from the brackets, if desired. That is, the brackets 18 could, if desired, be welded directly to the cooling coil assembly in order to maintain proper spacing and function for removal and replacement of the entire assembly. The refrigerant is brought in through pipe 32 at the top of the tank and delivered to the bottom to prevent leakage and to minimize any sealing problems.

Obviously, many modifications and variations of the present invention are possible in light of the above teachings. It is therefore to be understood that the full scope of the present invention is not limited to the details disclosed herein but may be practiced otherwise than as specifically described.

What is claimed is:

1. A cooler for extracting heat from a working fluid comprising:

a tank;

a reservoir at the bottom of said tank;

a plurality of cooling coils mounted in said tank;

an inlet for delivering a working fluid to be cooled in said tank;

metering means for metering the flow of working fluid over said cooling coils;

said metering means comprising a circular plate having a plurality of metering holes aligned with the respective coils in said plurality of cooling coils;

distribution control means for controlling the distribution of working fluid evenly over said metering plate;

said distribution control means comprising an overflow hole in the center of said metering plate;

an overflow barrier around said overflow hole;

a distribution barrier on said plate between said overflow barrier and said metering holes said inlet positioned to deliver working fluid onto said metering plate between said overflow barrier and said distribution barrier;

said overflow barrier having a predetermined height greater than the height of said distribution barrier whereby said working fluid flows through said inlet onto said metering plate and flows at a substantially even rate through all the metering holes.

2. The cooler acccording to claim 1 wherein said overflow barrier has a height approximately about three times the height of said distribution barrier.

3. The cooler according to claim 1 wherein said holes are arranged in a circular pattern adjacent to the periphery of said circular plate.

4. The cooler according to claim 1 including: a splash guard on said overflow barrier adjacent to said inlet.

5. The cooler according to claim 4 wherein said splash guard comprises:

an upward curved portion on said overflow barrier adjacent to said inlet; and said curved portion rising to approximately six times the height of the distribution barrier.

6. The cooler according to claim 1 wherein said metering holes are tapered a predetermined amount.

7. The cooler according to claim 16 wherein said metering holes are countersunk to provide a predetermined taper.

8. The cooler according to claim 7 wherein said metering holes are tapered in the range of 20′ to 40°.

9. The cooler according to claim 7 wherein said metering holes have approximately a 30° taper.

10. The cooler according to claim 1 wherein:

said cooling coils comprise three concentric coils; and said metering holes comprise three concentric circles of metering holes one circle of each concentric circle being aligned respectively with one of the concentric cooling coils.

11. The cooler according to claim 10 wherein said tank has an oval shape;

said cooling coils comprise two sets of three concentric coils; and said metering plate is oval in shape and has two sets of said three concentric circles of metering holes.

12. The cooler according to claim 10 including:

a coolant inlet manifold connected to the bottom end of said plurality of cooling coils;

a coolant outlet manifold connected to the top end of said plurality of cooling coils;

whereby coolant is circulated in a counterflow through said cooling coils from bottom to top.

13. The cooler according to claim 12 wherein said coolant inlet and outlet manifolds are connected for simultaneous parallel flow through said plurality of coils.

14. The cooler according to claim 13 wherein said cooling coils are constructed to be equal in capacity by making the cooling coil height successively longer from the outer concentric coil to the inner concentric coil.

* * * * *